US011657767B2

(12) United States Patent
Pyun et al.

(10) Patent No.: US 11,657,767 B2
(45) Date of Patent: May 23, 2023

(54) DISPLAY DEVICE AND DRIVING METHOD THEREOF FOR PREVENTING OVERCURRENT BY USING TOTAL LOAD AND LOCAL LOADS

(71) Applicant: SAMSUNG DISPLAY CO., LTD., Yongin-si (KR)

(72) Inventors: Ki Hyun Pyun, Yongin-si (KR); Sung In Kang, Yongin-si (KR); Kyun Ho Kim, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/536,181

(22) Filed: Nov. 29, 2021

(65) Prior Publication Data

US 2022/0084471 A1 Mar. 17, 2022

Related U.S. Application Data

(63) Continuation of application No. 16/834,207, filed on Mar. 30, 2020, now Pat. No. 11,189,234.

(30) Foreign Application Priority Data

May 10, 2019 (KR) ..... 10-2019-0055071

(51) Int. Cl.
*G09G 3/3275* (2016.01)

(52) U.S. Cl.
CPC ..... *G09G 3/3275* (2013.01); *G09G 2310/027* (2013.01); *G09G 2320/0233* (2013.01)

(58) Field of Classification Search
CPC ..... G09G 3/3275; G09G 2320/0233; G09G 2310/027
See application file for complete search history.

(56) References Cited

U.S. PATENT DOCUMENTS

2007/0002005 A1 1/2007 Kim et al.
2007/0146518 A1 6/2007 Hong et al.
2012/0038684 A1 2/2012 Ryu
2012/0306826 A1 12/2012 Tsuchi
(Continued)

FOREIGN PATENT DOCUMENTS

KR 10-2018-0035994 4/2018

OTHER PUBLICATIONS

Office Action dated Mar. 3, 2021 In Corresponding U.S. Appl. No. 16/834,207.

*Primary Examiner* — Kwang-Su Yang

(74) *Attorney, Agent, or Firm* — F. Chau & Associates, LLC

(57) ABSTRACT

Provided are a display device and a driving method thereof. The display device includes: a display panel for displaying an image, based on data signals supplied from data lines; a load controller for determining a scale factor for controlling a target luminance of the image displayed in the display panel, based on a load of first image data input from the outside; and a data driver for outputting data signals to the data lines, corresponding to the first image data corrected using the scale factor. The data driver includes a plurality of data driver chips coupled to at least one data line among the data lines. The load controller determines the scale factor, based on at least one of a total load of the first image data and local loads with respect to the respective data driver chips.

20 Claims, 7 Drawing Sheets

(56) References Cited

U.S. PATENT DOCUMENTS

| | | | | |
|---|---|---|---|---|
| 2014/0184670 | A1 | 7/2014 | Jeong et al. | |
| 2014/0198091 | A1 | 7/2014 | Shin et al. | |
| 2016/0232852 | A1* | 8/2016 | An | G09G 3/3291 |
| 2018/0090083 | A1 | 3/2018 | Kim et al. | |
| 2018/0331557 | A1 | 11/2018 | Zosimadis et al. | |
| 2018/0351386 | A1 | 12/2018 | Zosimadis et al. | |
| 2019/0130844 | A1* | 5/2019 | Yang | G09G 3/3275 |
| 2020/0013350 | A1* | 1/2020 | Huang | G09G 3/006 |
| 2020/0357344 | A1 | 11/2020 | Pyun et al. | |

* cited by examiner

DISPLAY DEVICE AND DRIVING METHOD THEREOF FOR PREVENTING OVERCURRENT BY USING TOTAL LOAD AND LOCAL LOADS

CROSS-REFERENCE TO RELATED APPLICATION

The present U.S. non-provisional application is a continuation application of U.S. patent application Ser. No. 16/834,207 filed Mar. 30, 2020, which claims priority under 35 U.S.C. § 119(a) to Korean patent application 10-2019-0055071 filed on May 10, 2019 in the Korean Intellectual Property Office, the entire disclosures of which are incorporated by their reference herein.

BACKGROUND

1. Technical Field

The present disclosure generally relates to a display device and a driving method thereof.

2. Discussion of Related Art

With the development of information technologies, the importance of a display device acting as a connection medium between a user and information increases. Accordingly, flat panel display devices such as a liquid crystal display device, an organic light emitting display device, and a plasma display panel are increasingly used.

A display device includes a display panel for displaying images. Power consumption may be reduced by limiting an amount of current flowing into the display panel, corresponding to a load of data.

In one current limiting technique, the display panel maintains a peak luminance when data is set to a predetermined load or less, and is gradually lowered when the data exceeds the predetermined load.

SUMMARY

At least one exemplary embodiment of the inventive concept provides a display device configured to limit a driving current of each of a plurality of data driver chips, based on a data load of the data driver chips, and a driving method of the display device.

At least one exemplary embodiment of the inventive concept provides a display device configured to determine a driving current limit value by comparing data loads of data driver chips, so that a luminance difference between the data driver chips is decreased, and a driving method of the display device.

At least one exemplary embodiment of the inventive concept provides a display device capable of preventing an overcurrent phenomenon caused by a difference in driving current between data driver chips, and a driving method of the display device.

According to an exemplary embodiment of the present disclosure, there is provided a display device including: a display panel configured to display an image, based on data signals supplied from data lines; a load controller configured to determine a scale factor for adjusting a target luminance of the image displayed in the display panel, based on a load of first image data input from the outside; and a data driver configured to output the data signals to the data lines, corresponding to second image data generated by correcting the first image data using the scale factor, wherein the data driver includes a plurality of data driver chips coupled to at least one data line among the data lines, wherein the load controller determines the scale factor, based on at least one of a total load of the first image data and local loads with respect to the respective data driver chips.

The load controller may include: a total load calculator configured to calculate the total load; a first comparator configured to output a first enable signal for determining the scale factor, when the total load is greater than a first threshold value; a local load calculator configured to calculate the local loads; and a second comparator configured to output a second enable signal for determining the scale factor, when at least some of the local loads are greater than a second threshold value.

The load controller may further include a mode determiner configured to output a first mode signal for determining the scale factor, based on the total load, and a second mode signal for determining the scale factor, based on the local loads.

The mode determiner may output one of the first mode signal and the second mode signal according to whether the first enable signal and the second enable signal are output. The mode determiner may output the second mode signal, when both the first enable signal and the second enable signal are output.

The total load calculator may calculate the total load in response to the first mode signal, and the local load calculator may calculate the local loads in response to the second mode signal.

The load controller may determine the target luminance corresponding to the total load, based on predetermined curve data, and determine the scale factor such that the target luminance of the image displayed in the display panel becomes the determined target luminance.

The load controller may include: a difference value generator configured to determine difference values with the local loads between adjacent data driver chips; and a calculator configured to determine the scale factor, based on whether the difference values exceed a predetermined threshold difference value.

The calculator may determine the scale factor corresponding to the local load, based on predetermined curve data, when difference values corresponding to a local load with respect to a given data driver chip among the data driver chips are smaller than the threshold difference value.

The calculator may determine a maximum value and a minimum value for the scale factor and a slope between the maximum value and the minimum value, when at least one of difference values corresponding to a local load with respect to a given data driver chip among the data driver chips is greater than the threshold difference value, and determine a plurality of sub-scale factors including at least one value between the maximum value and the minimum value.

The plurality of sub-scale factors may respectively correspond to at least one of the data lines coupled to the given data driver chip.

The calculator may determine a predetermined maximum value and a predetermined minimum value as the maximum value and the minimum value respectively, corresponding to the local load and the difference values.

The calculator may determine a reference scale factor corresponding to the local load, based on the predetermined curve data, determine the maximum value by adding a predetermined threshold range to the reference scale factor, and determine the minimum value by subtracting a predetermined second threshold range from the reference scale factor.

The slope may have a value fixed or varied between the maximum value and the minimum value.

According to an exemplary embodiment of the present disclosure, there is provided a method for driving a display device including a display panel for displaying an image, based on data signals supplied from data lines, and a data driver including a plurality of data driver chips coupled to at least one data line among the data lines, the method including: determining a scale factor for adjusting a target luminance of the image displayed in the display panel, based on a load of first image data input from the outside; outputting data signals to the data lines, corresponding to the second image data generated from correcting the first image data using the scale factor; and displaying the image in the display panel, based on the data signals, wherein the scale factor is determined based on at least one of a total load of the first image data and local loads with respect to the respective data driver chips.

The determining of the scale factor may include: calculating the total load; outputting a first enable signal for determining the scale factor, when the total load is greater than a first threshold value; calculating the local loads; and outputting a second enable signal for determining the scale factor, when at least some of the local loads are greater than a second threshold value.

The determining of the scale factor may further include: determining the target luminance corresponding to the total load, based on predetermined curve data; and determining the scale factor such that the target luminance of the image displayed in the display panel becomes the determined target luminance.

The determining of the scale factor may further include: determining difference values of the local loads between adjacent data driver chips; and calculating the scale factor, based on whether the difference values exceed a predetermined threshold difference value.

The calculating of the scale factor may include determining the scale factor corresponding to a given one of the local loads, based on predetermined curve data, when difference values corresponding to a local load with respect to a given data driver chip among the data driver chips are smaller than the threshold difference value.

The calculating of the scale factor may include: determining a maximum value and a minimum value for the scale factor and a slope between the maximum value and the minimum value, when at least one of a plurality of difference values corresponding to a local load with respect to a given data driver chip among the data driver chips is greater than the threshold difference value; and determining a plurality of sub-scale factors including at least one value between the maximum value and the minimum value.

The plurality of sub-scale factors may respectively correspond to at least one data line coupled to the arbitrary data driver chip.

According to an exemplary embodiment of the present disclosure, there is provided a display device including: a display panel configured to display an image, based on data signals supplied from a plurality of data lines; a data driver including a plurality of data driver chips, where each data driver chip provides part of the data signals to respective data lines of the plurality of data lines; a load controller configured to determine a plurality of scale factors, where each of the scale factors is associated with a corresponding one of the data driver chips based on a respective part of first image data input from the outside associated with the corresponding data driver chip; and a timing controller configured to generate second image data from the first image data and the scale factors, and apply the second image data to the data driver. The data driver generates the data signals from the second image data.

In an exemplary embodiment, the first image data includes grayscale values for a given data driver chip of the data driver chips and the timing controller generates the second image data by multiplying the greyscales values by the scale factor of the given data driver chip.

In an exemplary embodiment, the scale factor for a given data driver chip of the data driver chips includes a plurality of sub-scale factors, the first image data includes grayscale values for the given data driver chip, and the timing controller generates the second image data by multiplying the greyscales values by a line derived from the plurality of sub-scale factors.

DETAILED DESCRIPTION OF THE EXEMPLARY EMBODIMENTS

Figure 1:
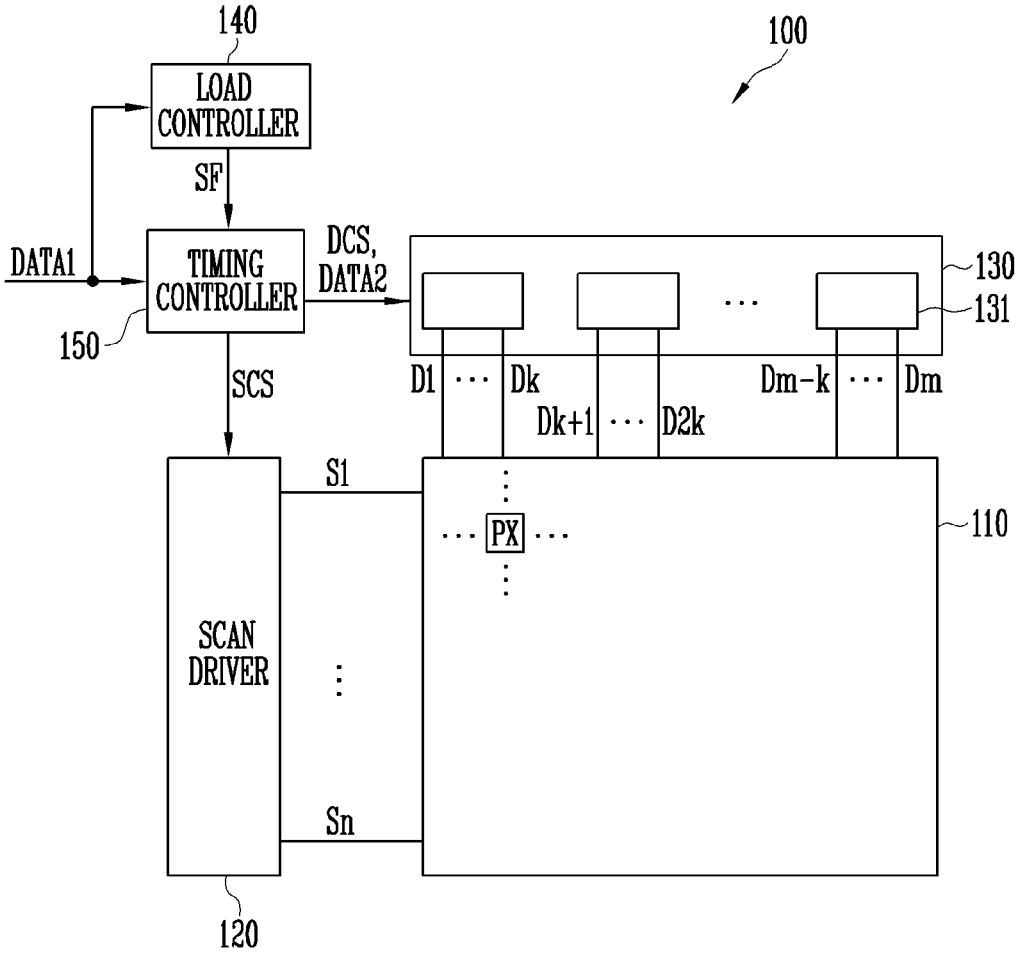
FIG. 1 is a block diagram illustrating a display device according to an exemplary embodiment of the present disclosure.

Hereinafter, exemplary embodiments of the present disclosure will be described in more detail with reference to the accompanying drawings. Throughout the drawings, the same reference numerals are given to the same elements, and their overlapping descriptions will be omitted.

Figure 2:
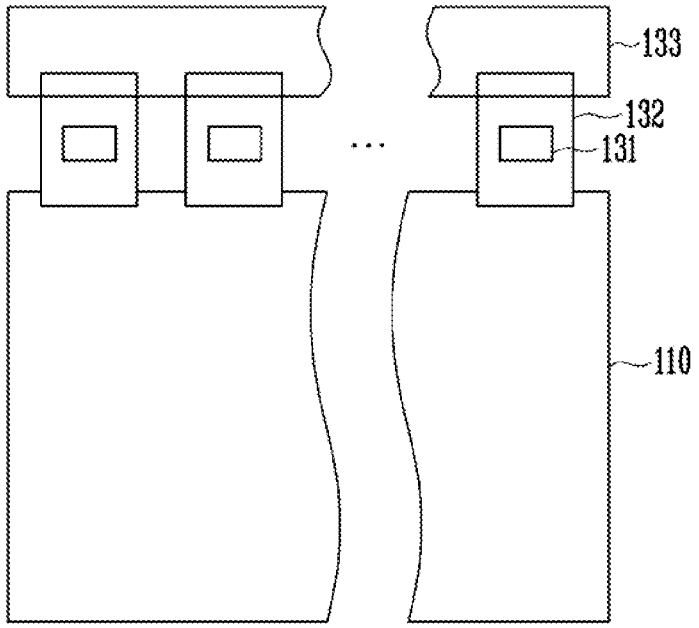
FIG. 2 is a schematic plan view of the display device shown in FIG. 1.

FIG. 1 is a block diagram illustrating a display device according to an exemplary embodiment of the present inventive concept. FIG. 2 is a schematic plan view of the display device shown in FIG. 1.

Referring to FIG. 1, the display device in accordance an exemplary embodiment of the present disclosure includes a display panel 110, a scan driver 120 (e.g., a gate driver or a driving circuit), a data driver 130 (e.g., a source driver or a driving circuit), a load controller 140 (e.g., a control circuit), and a timing controller 150 (e.g., a control circuit). The display device 100 may be a device configured to output an image, based on image data (e.g., first image data DATA1) provided from the outside. For example, the display device 100 may be an organic light emitting display device.

The display panel 110 may include a plurality of scan lines S1 to Sn (e.g., gate lines), a plurality of data lines D1 to Dm (e.g., source lines), and a plurality of pixels PX (or sub-pixels). Here, n and m may be integers of 2 or more.

The pixels PX may be arranged at intersection portions of the scan lines S1 to Sn and the data lines D1 to Dm. Each of the pixels PX may emit light, based on a scan signal supplied to a corresponding scan line among the scan lines S1 to Sn and a data signal supplied to a corresponding data line among the data lines D1 to Dm. A configuration of the pixel PX will be described in more detail with reference to FIG. 3.

The scan driver 120 may generate a first scan signal and a second scan signal, based on a scan driving control signal SCS. That is, the scan driver 120 may supply a scan signal to the pixels PX through the scan lines S1 to Sn during a display period.

The scan driving control signal SCS may be provided to the scan driver 120 from the timing controller 150. The scan driving control signal SCS may include a start pulse and clock signals. The scan driver 120 may include a shift register configured to sequentially generate scan signals, corresponding to the start pulse and the clock signals.

The data driver 130 may generate a data signal, based on a data driving control signal DCS and image data (e.g., second image data DATA2). The data driver 130 may provide the display panel 110 with a data signal generated according to the data driving control signal DCS during a display period in one frame. That is, the data driver 130 may supply data signals to the pixels PX through the data lines D1 to Dm. The data driving control signal DCS may be provided to the data driver 130 from the timing controller 150. For example, the data driver 130 may provide data signals based on the second image data DATA2 to the display panel 110 in synchronization with the data driving control signal DCS.

In an exemplary embodiments of the present disclosure, the data driver 130 is implemented by a plurality of data driver chips 131 and films 132 on which the data driver chips 131 are respectively mounted. In an embodiment, the data driver chips 131 and the films 132 constitute a Chip On the Film (COF). Specifically, the data driver chips 131 may be respectively mounted on the films for signal transmission in the form of a Tape Carrier Package (TCP). The data driver chips 131 may be coupled between a substrate constituting the display panel 110 and a driving circuit substrate 133 on which the timing controller 150 is mounted.

In addition, each of the data driver chips 131 may be coupled to at least some of the data lines D1 to Dm, to transmit data signals to pixels corresponding thereto. For example, a first data driver chip 131 may be coupled to first to kth data lines D1 to Dk, a second data driver chip 131 may be coupled to (k+1)th to 2kth data lines Dk+1 to D2k, and a last data driver chip 131 may be coupled to a (m−k)th to mth data lines Dm−k to Dm.

The load controller 140 generates a scale factor SF capable of controlling the luminance of image data (e.g., first image data DATA1) provided from the outside, corresponding to a load of the image data, and supplies the generated scale factor SF to the timing controller 150. In an embodiment, the load is a ratio of pixels of the display panel 110 that emit light. For example, when the display panel 110 emits light in full white, the load may be set to 100%. For example, when half of the display panel 110 emits light in full white and the remaining half of the display panel 110 is not emitting light (e.g., black), the load may be set to 50%.

In an embodiment, when a load (hereinafter, referred to as a total load) of the first image data DATA1 with respect to the entire region of the display panel 110 and a load (hereinafter, referred to as a local load) of the first image data DATA1 with respect to regions respectively corresponding to the data driver chips 131 exceed a predetermined threshold value, the load controller 140 generates a scale factor SF, based on the total load and the local load. The load controller 140 will be described in detail later.

The timing controller 150 may control operations of the scan driver 120 and data driver 130. The timing controller 150 may generate the scan driving control signal SCS and the data driving control signal DCS, and control each of the scan driver 120 and the data driver 130, based on the generated signals.

In an exemplary embodiment of the present disclosure, the timing controller 150 receives a scale factor from the load controller 140, and generates second image data DATA2 by correcting the first image data DATA1 in units of frames, corresponding to the scale factor SF. The second image data DATA2 generated from the timing controller 150 may be supplied to the data driver 130. The second image data DATA2 may be corrected and generated according to a scale factor SF determined by the data load such that the luminance of the first image data DATA1 is decreased.

Although an embodiment where the load controller 140 is a separate component is illustrated in FIG. 1, the present disclosure is not limited thereto. For example, in alternate embodiments of the present disclosure, the load controller 140 may be mounted in the timing controller 150, or be integrally formed with the timing controller 150. In an embodiment, a color control operation of the load controller 140, which will be described later, may be performed by the timing controller 150.

Figure 3:
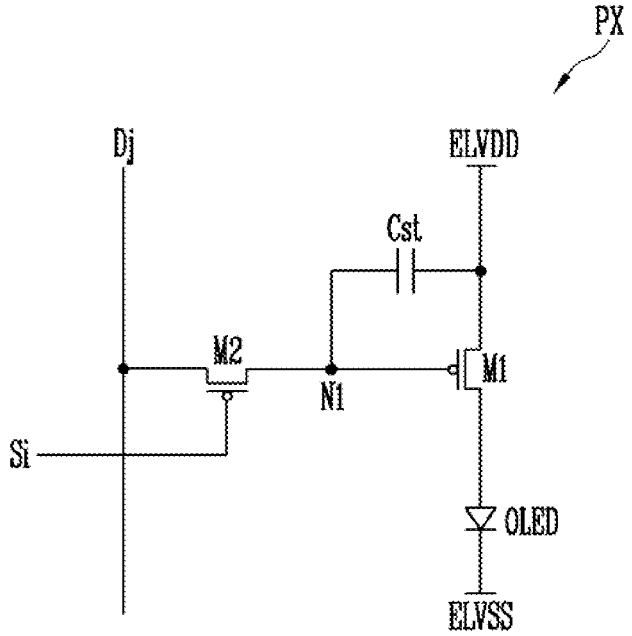
FIG. 3 is a circuit diagram illustrating an embodiment of a pixel shown in FIG. 1.

FIG. 3 is a circuit diagram illustrating an embodiment of the pixel shown in FIG. 1. For convenience of description, an example of a pixel PX coupled to an ith scan line Si and a jth data line Dj is illustrated in FIG. 3.

Referring to FIG. 3, the pixel PX includes a first transistor M1, a second transistor M2, a storage capacitor Cst, and a light emitting device OLED (e.g., an organic light emitting diode).

The first transistor (driving transistor) M1 includes a first electrode coupled to a first driving power source ELVDD, a second electrode coupled to the light emitting device OLED, and a gate electrode coupled to a first node N1. The first transistor M1 may control an amount of driving current flowing through the light emitting device OLED, corresponding to a voltage value between gate and source thereof.

The second transistor (e.g., switching transistor) M2 includes a first electrode coupled to the data line Dj, a gate electrode coupled to the scan line Si, and a second electrode coupled to the first node N1. The second transistor M2 may be turned on when a scan signal is supplied through the scan line Si, to supply a data signal to the data line Dj to the storage capacitor Cst or to control a potential of the first node N1. The storage capacitor Cst coupled between the first node N1 and the first electrode of the first transistor M1 may charge a voltage corresponding to the data signal.

The light emitting device OLED includes a first electrode (e.g., an anode electrode) coupled to the second electrode of the first transistor M1 and a second electrode (e.g., a cathode electrode) coupled to a second driving power source ELVSS. The light emitting device OLED generates light corresponding to an amount of current supplied from the first transistor M1. In an exemplary embodiment of the present disclosure, the light emitting device OLED generates light corresponding to any one color among red, green, and blue. However, the light emitting device OLED is not limited to generating light of any particular color. For example, the light emitting device OLED may generate light of colors different than red, green, and blue. In an exemplary embodiment, the second driving power source ELVSS has a lower voltage level than the first driving power source ELVDD.

In FIG. 3, the first electrode of each of the transistors M1 and M2 may be set as any one of a source electrode and a drain electrode, and the second electrode of each of the transistors M1 and M2 may be set as the other of the source electrode and the drain electrode. For example, when the first electrode is set as the source electrode, the second electrode may be set as the drain electrode.

In addition, the transistors M1 and M2 may be implemented with a PMOS (e.g., a P-type metal-oxide-semiconductor) transistor as shown in FIG. 3. However, the present disclosure is not limited thereto, and the transistors M1 and M2 may be implemented with an NMOS (e.g., a N-type metal-oxide-semiconductor) transistor. In an embodiment, the circuit of the pixel PX may be variously modified to be suitable for driving the NMOS transistor.

Figure 4:
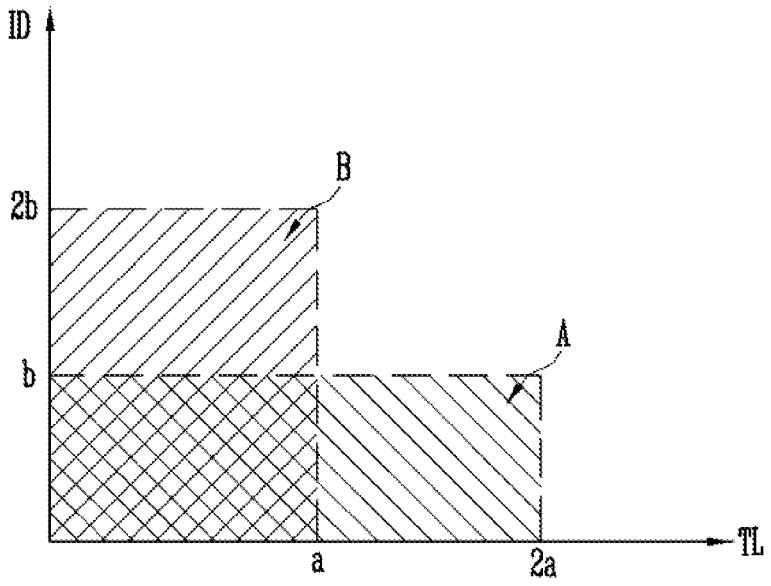
FIG. 4 is diagram illustrating power consumption of a display panel shown in FIG. 1.

FIG. 4 is diagram illustrating exemplary power consumption of the display panel shown in FIG. 1.

Referring to FIG. 4, the power consumption of the display panel 110 is in proportion to a multiple of a total load TL of image data and a total driving current ID supplied to the pixels. That is, the power consumption of the display panel 110 is in proportion to each of the total load TL and the total driving current ID.

Accordingly, the power consumption of the display panel 110 may be in proportion to the area of a rectangle having the total load TL of the image data as one side and the total driving current ID as another side. For example, when the total load TL of the image data has a value of 2a and the total driving current ID has a value of b, the power consumption of the display panel 110 may be in proportion to the area A of a rectangle having 2a as one side and b as another side (2a×b=2ab). On the contrary, when the total load TL of the image data has a value of a and the total driving current ID has a value of 2b, the power consumption of the display panel 110 may be in proportion to the area B of a rectangle having a as one side and 2b as another side (a×2b=2ab). Since the areas A and B of the two rectangles are substantially the same, the power consumptions of the display panel 110 in the two embodiments may be substantially the same.

As described above, when the total load TL of the image data is greater than a predetermined threshold value, the display device 100 limits the power consumption of the display panel 110 within a threshold range by adjusting the total driving current ID, corresponding to the total load TL. However, when the total load TL of the image data is smaller than the predetermined threshold value, the display device 100 does not limit the total driving current ID. When the total load TL of the image data is concentrated on a region corresponding to a specific data driver chip 131, the corresponding data driver chip 131 provides the display panel 110 with a data signal for a driving current that is not limited, and therefore, the display panel 110 may be burnt in a region of the display panel 110, which is adjacent the corresponding data driver chip 131, due to overcurrent.

In the present disclosure, in order to prevent this problem, there is provided a display device configured to determine a load of image data, i.e., a local load with respect to each of the data driver chips 131, and perform current limitation such that the local load does not exceed a predetermined threshold value. This will be described in more detail below.

Figure 5:
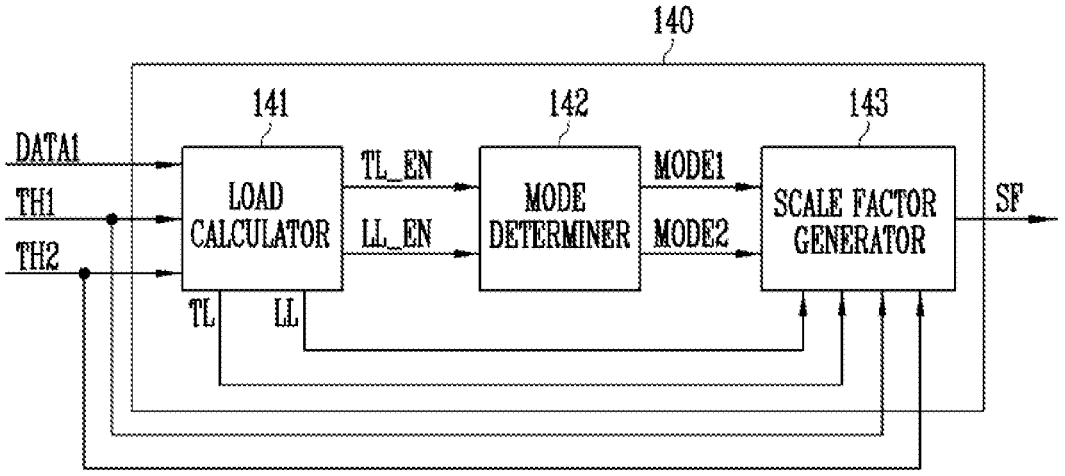
FIG. 5 is a block diagram illustrating an exemplary embodiment of a load controller shown in FIG. 1.
Figure 6:
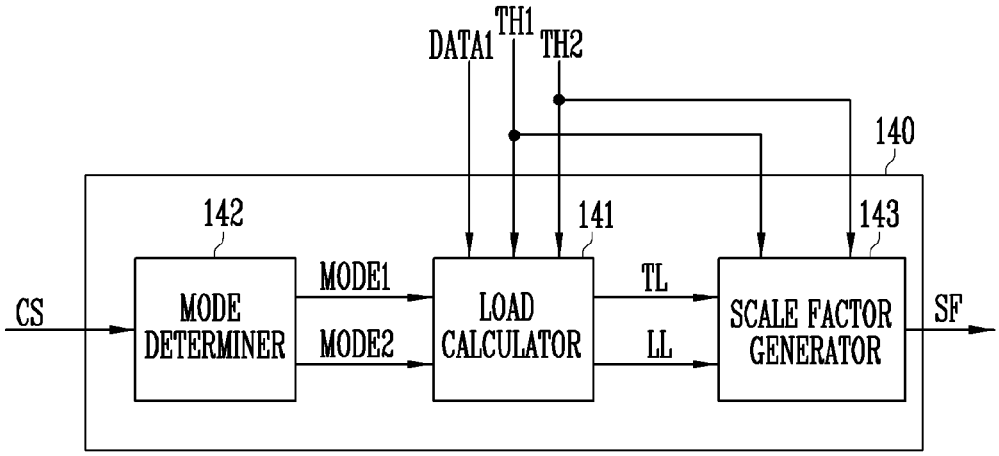
FIG. 6 is a block diagram illustrating an exemplary embodiment of the load controller shown in FIG. 1.

FIG. 5 is a block diagram illustrating an exemplary embodiment of the load controller shown in FIG. 1. FIG. 6 is a block diagram illustrating another embodiment of the load controller shown in FIG. 1.

Referring to FIG. 5, the load controller 140 in accordance with an exemplary embodiment of the present disclosure includes a load calculator 141 (e.g., a circuit), a mode determiner 142 (e.g., a circuit), and a scale factor generator 143 (e.g., a circuit).

The load calculator 141 calculates a load of first image data DATA1 input thereto. In an exemplary embodiment of the present disclosure, the load calculator 141 determines a total load TL of the first image data DATA1 and local loads LL of the first image data DATA1 with respect to the respective data driver chips 131.

In an embodiment, the total load TL is in proportion to a driving current sum of the entire display panel 110 according to the first image data DATA1. Also, in an embodiment, the local load LL is in proportion to a driving current sum of a corresponding data driver chip 131 according to the first image data DATA1. For example, the total load TL and the local load LL may be calculated according to the following Equation 1.

$$L = \frac{(IOR + IOG + IOB)}{(IOR_{max} + IOG_{max} + IOB_{max})} \quad \text{[Equation 1]}$$

L is the total load TL or local load LL, IOR, IOG, and IOB are respectively current values corresponding to RGB values of the first image data DATA1, and $IOR_{max}$, $IOG_{max}$, and $IOB_{max}$ are respectively maximum values of the current values corresponding to the RGB values of the first image data DATA1. For example, if the display panel 110 includes A red pixels, B green pixels, and C blue pixels, when L is the total load TL, TOR is the sum of currents of the A red pixels, IOG is the sum of currents of the B green pixels, IOB is the sum of the currents of the C blue pixels, H is the maximum current of a red pixel, I is the maximum current of a G pixel, and J is a maximum current of a blue pixel, then $IOR_{max}$ is A*H, $IOG_{max}$ is B*I, and $IOB_{max}$ is C*J. For example, if a part of the display panel 110 driven by one data driver chip 133 includes D red pixels (e.g., D is less than A), E green pixels (e.g., E<B), and F blue pixels (e.g., F<C), when L is the local load LL of the part, IOR is the sum of currents of the D red pixels, IOG is the sum of currents of the E green pixels, and IOB is the sum of the currents of the F blue pixels, then $IOR_{max}$ is D*H, $IOG_{max}$ is E*I, and $IOB_{max}$ is F*J. The load calculator 141 may calculate the local load LL for each distinct part of the display panel 110 that is driven by a corresponding one of the data driver chips 133. For example, if there are 16 data driver chips 133, the load calculator 141 would calculate 16 different local loads LL. However, embodiments of the disclosure are not limited to any particular number of data driving chips 133, as there may be more or less than 16 data driver chips 133 in alternate embodiments.

However, the method for determining a load of image data is not limited to the above Equation 1 or examples.

In an exemplary embodiment, the load calculator 141 compares the determined total load TL and the determined local loads LL respectively with a predetermined first threshold value TH1 and a predetermined second threshold value TH2. In an exemplary embodiment, the load calculator 141 compares the total load TL with the first threshold value TH1 and compares each of the local loads LL with the second threshold value TH2. Also, the load calculator 141 may sequentially compare the local loads LL with the second threshold value TH2.

In various embodiments, the first threshold value TH1 and the second threshold value TH2 may be set as the same value or different values. For example, the first threshold value TH1 and the second threshold value TH2 may be set to 20%, but the present disclosure is not limited thereto.

The load calculator 141 may output a first enable signal TL_EN when the total load TL exceeds the first threshold value TH1. Also, the load calculator 141 may output a second enable signal LL_EN when at least one of the local loads LL exceeds the second threshold value TH2. Alternatively, the load calculator 141 may output the second enable signal LL_EN when a predetermined number or more of local loads among the local loads LL exceed the second threshold value TH2. In an alternate embodiment, the first enable signal TL_EN and the second enable signal LL_EN are always output, but their logic states vary based how the total load TL compares to the first threshold value TH1 and how the local loads LL compare to the second threshold value TH2. For example, the first enable signal TL_EN may have a high state when the total load TL exceeds the first threshold value TH1 and a low state otherwise. For example, the second enable signal LL_EN may have a high state when at least one of the local loads LL exceeds the second threshold value TH2 and a low state otherwise. For example, the second enable signal LL_EN may have a high state when a predetermined number or more of local loads among the local loads LL exceed the second threshold value TH2 and a low state otherwise.

The mode determiner 142 may select a current limit mode, based on the first enable signal TL_EN and/or the second enable signal LL_EN, output from the load calculator 141. For example, when the first enable signal TL_EN is received from the load calculator 141 and the second enable signal LL_EN is not received from the load calculator 141, the mode determiner 142 may output a first mode signal MODE1 for performing current limit, based on the total load TL and the first threshold value TH1. For example, when the second enable signal LL_EN is received from the load calculator 141 and the first enable signal TL_EN is not received from the load calculator 141, the mode determiner 142 may output a second mode signal MODE2 for performing current limit, based on the local loads LL and the second threshold value TH2.

When both the first enable signal TL_EN and the second enable signal LL_EN are received from the load calculator 141, the mode determiner 142 may output the second mode signal MODE2 for performing the current limit, based on the local loads LL and the second threshold value TH2. That is, when the total load TL of the first image data DATA1 exceeds the first threshold value TH1 and at least some of the local loads LL exceed the second threshold value TH2, the mode determiner 142 may perform current limit by preferentially considering the local load LL. However, the present disclosure is not limited thereto, and various modes may be set.

In an exemplary embodiment, the mode determiner 142 outputs a first mode signal MODE1 for performing current limit, based on the total load TL and the first threshold value TH1 when the first enable signal TL_EN is high and the second enable signal LL_EN is low. In an exemplary embodiment, the mode determiner 142 outputs a second mode signal MODE2 for performing current limit, based on the local loads LL and the second threshold value TH2 when i) the first enable signal TL_EN is low and the second enable signal LL_EN is high or ii) the first enable signal TL_EN is high and the second enable signal LL_EN is high.

Although an embodiment where the mode determiner 142 is provided posterior to the load calculator 141 is illustrated in FIG. 5, the present disclosure is not limited thereto. That is, in various embodiments, the mode determiner 142 may be provided prior to the load calculator 141 as shown in FIG. 6. In an embodiment, the load calculator 141 may determine or may not determine the local load LL according to a mode determined by the mode determiner 142. Then, the scale factor generator 142 which will be described later may operate a first mode or a second mode according to whether the local load LL is output from the load calculator 141.

In the embodiment shown in FIG. 6, the mode determiner 142 may determine a mode according to a control signal CS provided from the outside.

The scale factor generator 143 of FIG. 5 generates a scale factor SF based on the total load TL or local load LL, in response to the mode signal MODE1 or MODE2 received from the mode determiner 142. For example, when the first mode signal MODE1 is received from the mode determiner 142, the scale factor generator 143 operates in a first mode to generate a scale factor SF, based on the total load TL and the first threshold value TH1. For example, when second mode signal MODE2 is received from the mode determiner 142, the scale factor generator 143 operates in a second mode to generate a scale factor SF, based on the local loads LL and the second threshold value TH1. In the second mode (i.e., the second mode signal MODE2 is received), the scale factor generator 143 may generate scale factors with respect to the respective data driver chips 131, based on the local loads LL of the respective data driver chips 131. In an alternate embodiment, the mode determiner 142 outputs a single mode signal set to indicate whether the scale factor generator 143 should operate in the first or second mode. For example, the mode determiner 142 could output a mode signal at a high state to cause the scale factor generator 143 to operate in the first mode and output the mode signal at a low state to cause the scale factor generator 143 to operate in the second mode.

In an embodiment, the scale factor SF is a variation in driving voltage as a correction value for the first image data DATA1. Due to the image data (i.e., second image data DATA2) being corrected according to the scale factor SF, the data voltage applied to the circuit of the pixel PX shown in FIG. 3 is changed, and the amount of driving current flowing through the light emitting device OLED may be controlled. When the amount of driving current of each pixel PX is controlled, the power consumption of the display panel 110 can be consequently controlled.

The scale factor generator 143 may output the generated scale factor SF to the timing controller 150. The timing controller 150 may generate second image data DATA2 obtained by correcting the first image data DATA1, based on the received scale factor SF, and transfer the second image data DATA2 to the data driver 130.

In the first mode, the scale factor generator 143 determines a scale factor SF, based on the total load TL and the first threshold value TH1. In an embodiment during the first mode, the timing controller 150 generates second image data DATA2 by equally applying the determined scale factor SF with respect to all the data driver chips 131. For example, if the scale factor SF is 50%, and the timing controller 150 receives image data DATA1 including a first grayscale for a first data line D1 associated with a first data driver chip 131 and a second grayscale for a k+1 data line Dk+1 associated with a second data driver chip 133, the timing controller 150 could generate second image data DATA2 by multiplying the first grayscale by 50% and multiplying the second grayscale by 50%.

In the second mode, the scale factor generator 143 determines a scale factor SF, based on the local loads LL and the second threshold value TH2. That is, in the second mode, the scale factor generator 143 determines a scale factor SF with respect to each of the data driver chips 131. For example, if there are 16 data driver chips 131, the scale factor generator 143 would generate 16 scale factors. In an embodiment during the second mode, the timing controller 150 generates second image data DATA2 by applying a scale factor SF individually determined with respect to each of the data driver chips 131. For example, if the first scale factor for a first data driver chip 133 is 60% and the second scale factor for a second data driver chip 133 is 70%, and the timing controller 150 receives image data DATA1 including a first grayscale for a first data line D1 associated with the first data driver chip 131 and a second grayscale for a k+1 data line Dk+1 associated with the second data driver chip 133, the timing controller 150 could generate second image data DATA2 by multiplying the first grayscale by 60% and multiplying the second grayscale by 70%.

A detailed method for generating a scale factor SF, based on the total load TL and the first threshold value TH1 or the local loads LL and the second threshold value TH2, will be described below.

Figure 7:
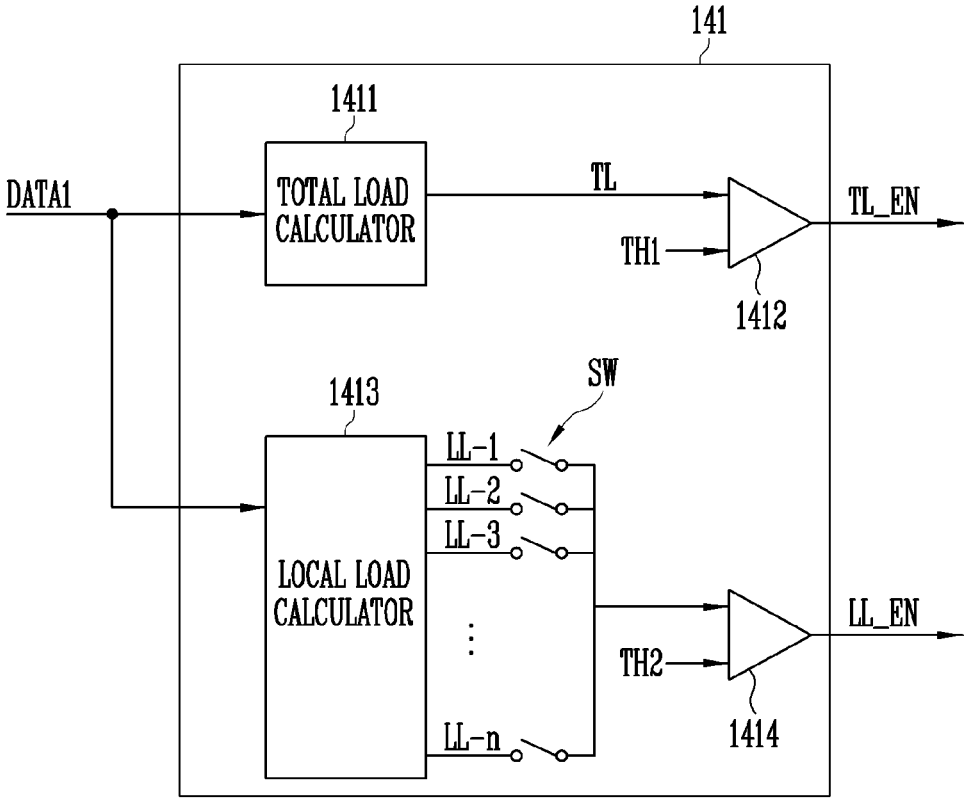
FIG. 7 is a block diagram illustrating an exemplary embodiment of a load calculator shown in FIG. 5.

FIG. 7 is a block diagram illustrating an exemplary embodiment of the load calculator shown in FIG. 5.

Referring to FIG. 7, the load calculator 141 includes a total load calculator 1411, a first comparator 1412 (e.g., a comparison circuit), a local load calculator 1413, and a second comparator 1414 (e.g., a comparison circuit).

The total load calculator 1411 may receive first image data DATA1. The total load calculator 1411 may determine a total load TL of the first image data DATA1 with respect to the entire region of the display panel 110. The total load TL may be in proportion to a driving current sum of the entire display panel 110 according to the first image data DATA1.

The total load measured by the total load calculator 1411 may be provided to the first comparator 1412. The first comparator 1412 may receive the first threshold value TH1.

The first comparator 1412 compares the total load TL with the first threshold value TH1. When the total load TL is greater than the first threshold value TH1, the first comparator 1412 outputs the first enable signal TL_EN. On the contrary, when the total load TL is not greater than the first threshold value TH1, the first comparator 1412 does not output the first enable signal TL_EN. In an alternate embodiment, when the total load TL is greater than the first threshold value TH1, the first comparator 1412 outputs the first enable signal TL_EN set to a first logic state and when the when the total load TL is not greater than the first threshold value TH1, the first comparator 1412 outputs the first enable signal TL_EN set to a second other logic state. For example, the first logic state indicates the total load TL is greater than the first threshold value TH1 and the second logic state indicates the total load TL is not greater than the first threshold value TH1.

In an exemplary embodiment of the present disclosure, the first comparator 1412 is implemented by an amplifier that receives the total load TL through a first input terminal and receive the first threshold value TH1 through a second input terminal. However, the configuration of the first comparator 1412 is not limited thereto.

The local load calculator 1413 may receive the first image data DATA1. Alternatively, the local load calculator 1413 may receive the total load TL measured by the total load calculator 1411.

The local load calculator 1413 may calculate local loads LL-1, LL-2, LL-3, . . . , and LL-n of the first image data DATA1 with respect to regions on the display panel 110, which respectively correspond to the data driver chips 131. For example, local load LL-1 may correspond to a first region of the display panel 110 including first pixels connected to data lines D1-Dk, local load LL-2 may correspond to a second region of the display panel 110 including second pixels connected to data lines Dk+1-D2k, etc. For example, RGB values included in the first image data DATA1 may be mapped to each of the pixels PX on the display panel 110. Since pixels PX receive a data signal from a corresponding data driver chip 131 among the data driver chips 131, the one data driver chip 131 may correspond to a region configured with the corresponding pixels PX on the display panel 110. Therefore, the local load calculator 1413 may calculate a load from RGB data for pixels included in an arbitrary region, and determine the calculated load as a local load LL of the data driver chip 131 corresponding to the corresponding region. However, the method in which the individual load calculator 1413 measures the local load LL is not limited to the above-described method. When the first image data DATA1 is supplied to the data driver 130, any algorithm or calculation method may be applied as long as a local load LL applied to each of the data driver chips 131 can be determined.

The local loads LL-1, LL-2, LL-3, . . . , and LL-n measured by the local load calculator 1413 may be sequentially provided to the second comparator 1414. To this end, as shown in FIG. 7, switches SW that are sequentially opened/closed may be provided between the local load calculator 1413 and the second comparator 1414. In an exemplary embodiment, the switches SW may be implemented by transistors.

The second comparator 1414 receives the second threshold value TH2. The second comparator 1414 compares the sequentially input local loads LL-1, LL-2, LL-3, . . . , and LL-n with the second threshold value TH2. When any one of the local loads LL-1, LL-2, LL-3, . . . , and LL-n is greater than the second threshold value TH2, the second comparator 1414 outputs the second enable signal LL_EN. On the contrary, when all of the local loads LL-1, LL-2, LL-3, . . . , and LL-n are not greater than the second threshold value TH2, the second comparator 1414 does not output the second enable signal LL_EN. In an alternate embodiment, the second comparator 1414 outputs the second enable signal LL_EN set to a first logic state when any one of the local loads LL-1, LL-2, LL-3, . . . , and LL-n is greater than the second threshold value TH2 and outputs the second enable signal LL_EN set to a second other logic state when all of the local loads LL-1, LL-2, LL-3, . . . , and LL-n are not greater than the second threshold value TH2.

In an exemplary embodiment, when a predetermined number of local loads among the local loads LL-1, LL-2, LL-3, . . . , and LL-n is greater than the second threshold value TH2, the second comparator 1414 outputs the second enable signal LL_EN. In an exemplary embodiment, the second comparator 1414 includes a buffer configured to temporarily store the comparison result of the local loads LL-1, LL-2, LL-3, . . . , and LL-n and the second threshold value TH2 or a counter configured to count a number of local loads greater than the second threshold value TH2. However, the configuration of the second comparator 1414 is not limited thereto.

Figure 8:
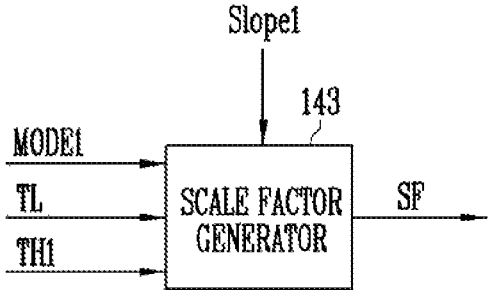
FIG. 8 is a block diagram illustrating an exemplary embodiment of a scale factor generator shown in FIG. 5.
Figure 9:
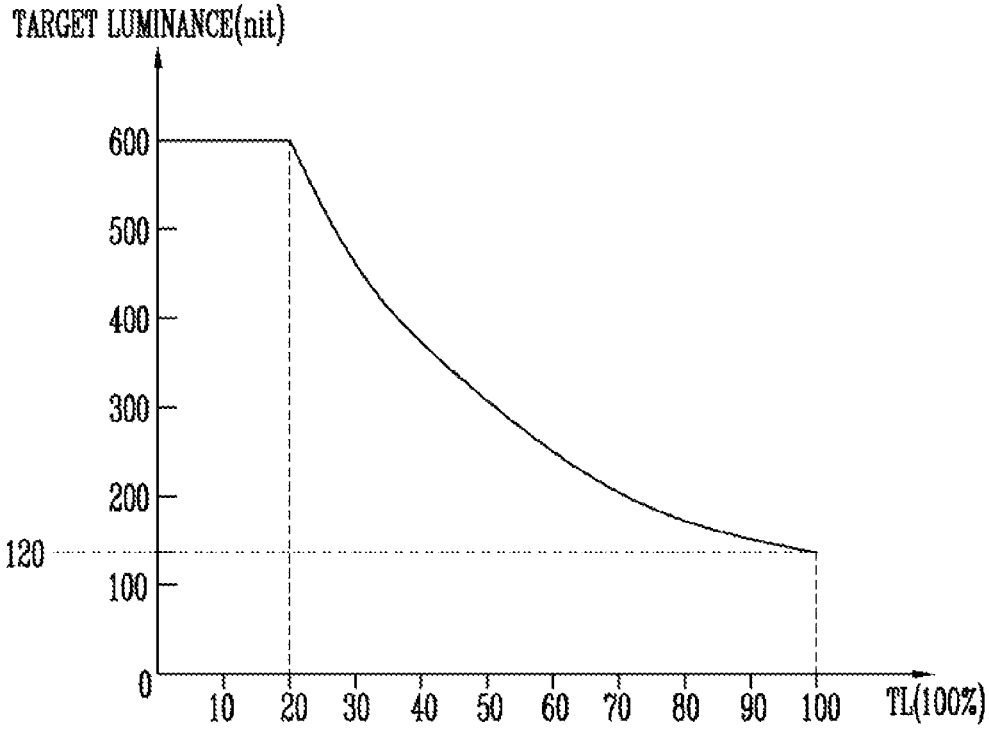
FIG. 9 is a graph illustrating an embodiment of first curve data.

FIG. 8 is a block diagram illustrating an exemplary embodiment of the scale factor generator shown in FIG. 5. FIG. 9 is a graph illustrating an embodiment of first curve data. In FIG. 8, an embodiment when the scale factor generator 143 operates in the first mode is illustrated.

When the scale factor generator 143 receives the first mode signal MODE1 from the mode determiner 142, the scale factor generator 143 generates a scale factor SF according to the total load TL and the first threshold value TH1.

In an embodiment, the scale factor generator 143 determines a scale factor SF, based on first curve data Slope1. For example, as shown in FIG. 9, the first curve data Slope1 may include a target luminance value (corresponding to a load value) of corrected image data (i.e., second image data DATA2) corresponding to the total load TL of the first image data DATA1. The scale factor generator 143 may determine a scale factor SF such that the luminance of second image data DATA2 corrected by the scale factor SF becomes a target luminance defined by the first curve data Slope1. The total load of the corrected second image data DATA2 may not exceed the first threshold value TH1. In various embodiments, the first curve data Slope1 may be set in the form of a Look Up Table (LUT), a calculation expression, etc. For example, when the scale factor generator 143 receives the first mode signal MODE1, the scale factor generator 143 generates a scale factor SF using a curve, a LUT, or a calculation expression that is associated with the first mode. For example, the curve associated with the first mode maps a given total load TL to a given target luminance. For example, as shown in FIG. 9, when the scale factor generator 143 receives the first mode signal MODE1, and the total load TL it receives is 100% (e.g., all the pixels are white), then a target luminance of 120 is returned. In an exemplary embodiment, the scale factor SF is generated by dividing the determined target luminance by a maximum luminance. For example, if the determined target luminance is 120 and the maximum luminance is 600, then the scale factor SF would 20%. For example, grayscales within the first image data DATA1 could be multiplied by 20% to generate the second image data DATA2.

The scale factor generator 143 may output the scale factor determined as described above to the outside.

Figure 10:
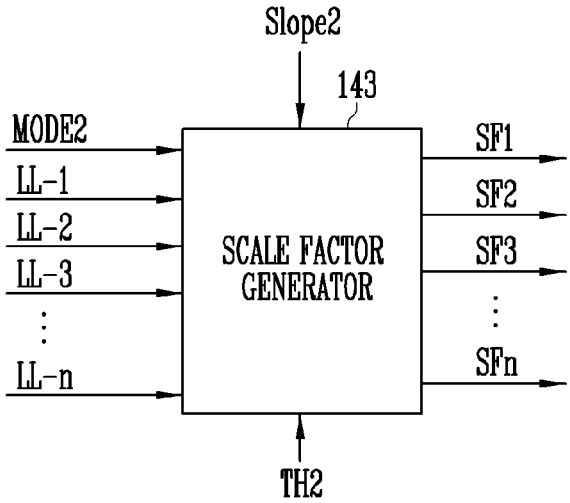
FIG. 10 is a block diagram illustrating an exemplary embodiment of the scale factor generator shown in FIG. 5.

FIG. 10 is a block diagram illustrating another embodiment of the scale factor generator shown in FIG. 5. In FIG. 10, an embodiment when the scale factor generator 143 operates in the second mode.

The scale factor generator 143 receives the second mode signal MODE2 from the mode determiner 142. Then, the scale factor generator 143 generates scale factors SF1, SF2, SF3, . . . , and SFn with respect to the respective data driver chips 131 according to the local loads LL-1, LL-2, LL-3, . . . , and LL-n and the second threshold value TH2.

In an exemplary embodiment, the scale factor generator 143 determines scale factors SF1, SF2, SF3, . . . , and SFn, based on a second curve data Slope2. The second curve data Slope2 is, for example, data similar to the first curve data Slope1 shown in FIG. 9, and may include a target luminance value (corresponding to a load value of the data driver chip 131) of corrected image data (i.e., second image data DATA2) corresponding to values of the local loads LL-1, LL-2, LL-3, . . . , and LL-n of the first image data DATA1. The second curve data Slope2 may be equal to or different from the first curve data Slope1.

The scale factor generator 143 may determine scale factors SF1, SF2, SF3, . . . , and SFn such that the luminance of second image data DATA2 corrected by the scale factors SF1, SF2, SF3, . . . , and SFn becomes a target luminance defined by the second curve data Slope2. The local load of the corrected second image data DATA2 may not exceed the second threshold value TH2.

Figure 11:
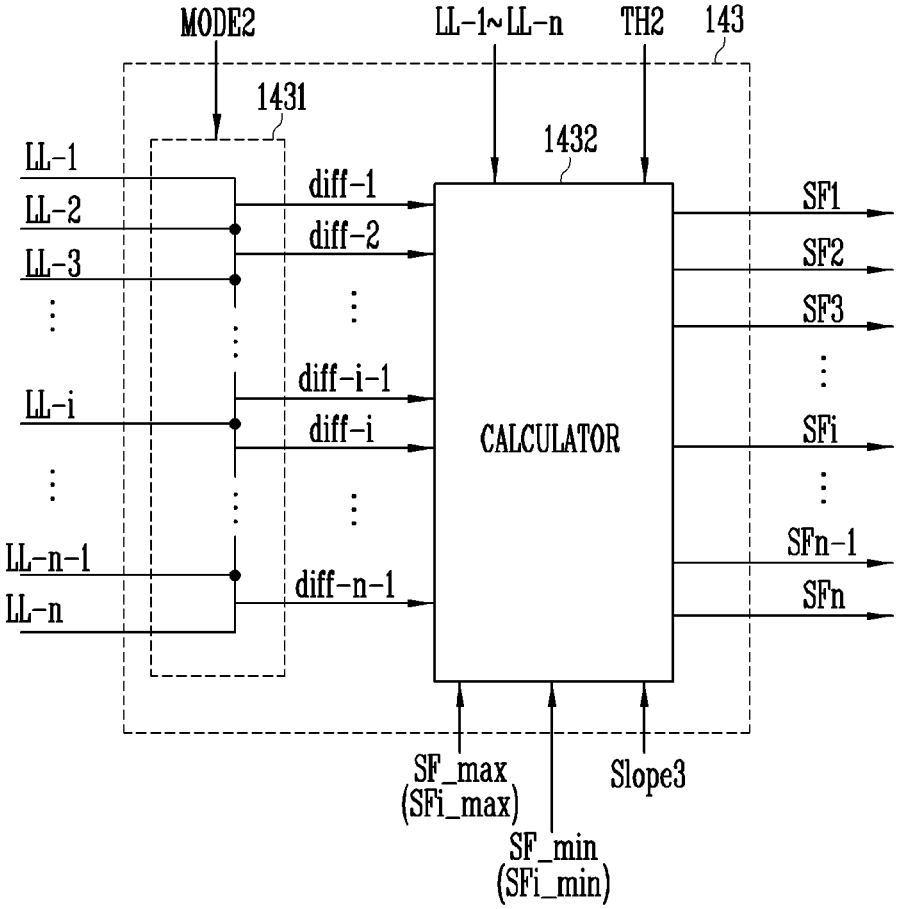
FIG. 11 is a block diagram illustrating an exemplary embodiment of the scale factor generator shown in FIG. 5.
Figure 12:
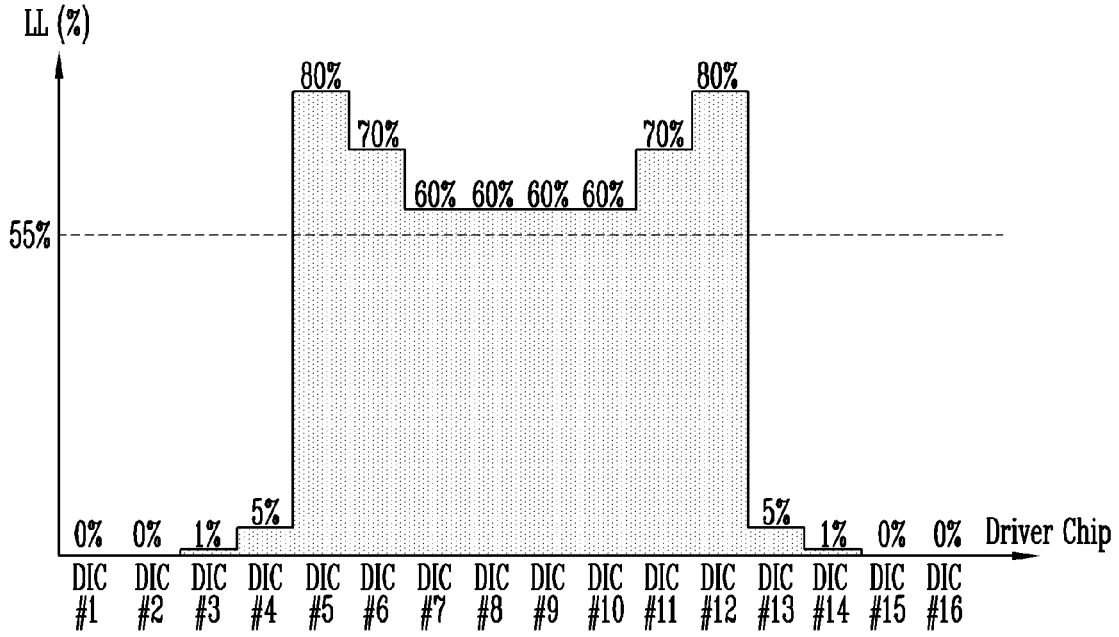
FIGS. 12 and 13 are diagrams illustrating an example of local loads of data driver chips, which are controlled by a scale factor.
Figure 13:
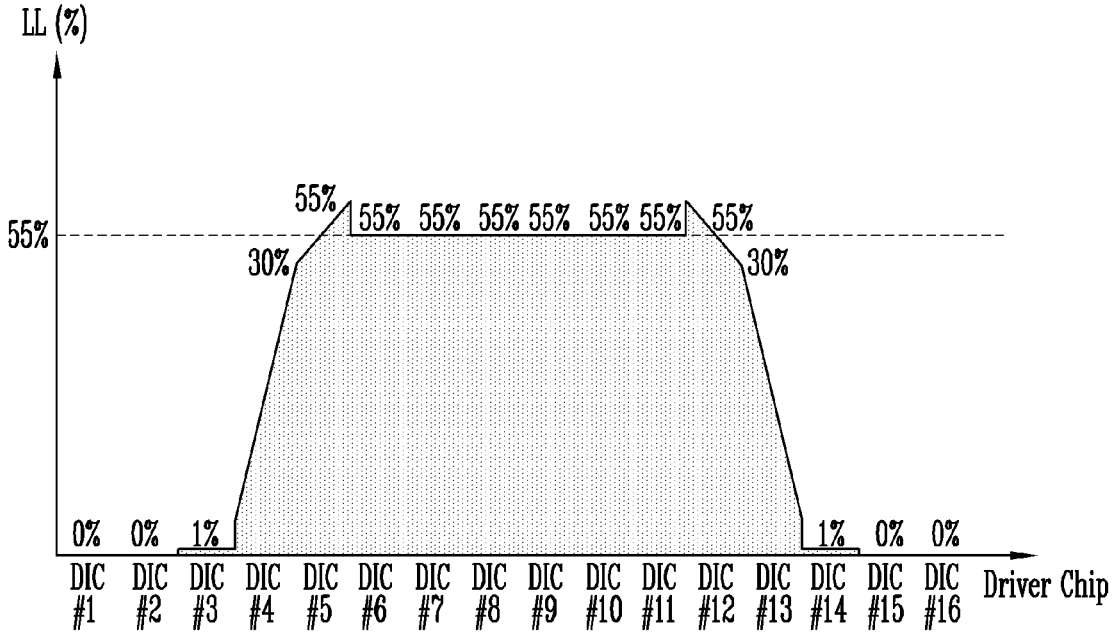

FIG. 11 is a block diagram illustrating an exemplary embodiment of the scale factor generator shown in FIG. 5. FIGS. 12 and 13 are diagrams illustrating an example of local loads of the data driver chips, which are controlled by a scale factor. In FIG. 10, an embodiment when the scale factor generator 143 operates in the second mode is illustrated.

The scale factor generator 143 receives the second mode signal MODE2 from the mode determiner 142. Then, the scale factor generator 143 generates scale factors SF1, SF2, SF3, . . . , and SFn with respect to the respective data driver chips 131 according to the local loads LL-1, LL-2, LL-3, . . . , and LL-n and the second threshold value TH2. In an embodiment, the scale factor generator 143 of FIG. 10 includes a difference value generator 1431 and a calculator 1432 of FIG. 11.

The difference value generator 1431 receives local loads LL-1, LL-2, LL-3, . . . , and LL-n measured by the local load calculator 1413. The difference value generator 1431 may calculate a difference value diff with respect to local loads LL of adjacent data driver chips 131.

Specifically, the difference value generator 1431 may calculate a first difference value diff-1 between a first local load LL-1 of a first data driver chip 131 and a second local load LL-2 of a second data driver chip 131. Also, the difference value generator 1431 may calculate a second difference value diff-2 between the second local load LL-2 of the second data driver chip 131 and a third local load LL-3 of a third data driver chip 131. Also, the difference value generator 1431 may calculate an (n−1)th difference value diff-n−1 between an (n−1)th local load LL-n−1 of an (n−1)th data driver chip 131 and an nth local load LL-n of an nth data driver chip 131. The difference value generator 1431 may include one or more logic circuits such as a subtractor to calculate each difference.

The calculator 1432 receives first to (n−1)th difference values diff-1, diff-2, . . . , and diff-n−1 from the difference value generator 1431. Also, the calculator 1432 receives first to nth local loads LL-1, LL-2, LL-3, . . . , and LL-n. The calculator 1432 determines scale factors SF1, SF2, SF3, . . . , SFn, based on the received first to (n−1)th difference values diff-1, diff-2, . . . , and diff-n−1 and the received first to nth local loads LL-1, LL-2, LL-3, . . . , and LL-n.

As for the method in which the calculator 1432 determines a scale factor SF, a method in which the calculator 1432 determines an ith scale factor SFi, corresponding to an ith local load LL-i of the ith data driver chip 131 will be described below as an example.

The calculator 1432 receives the ith local load LL-i and ith and (i+1)th difference values diff-i and diff-i+1. In an embodiment, when the ith and (i+1)th difference values diff-i and diff-i+1 are not greater than a predetermined threshold difference value, the calculator 1432 determines the ith scale factor SFi as described with reference to FIG. 10, and outputs the determined ith scale factor SFi as a scale factor SF for the ith data driver chip 131.

That is, the calculator 1432 may determine the ith scale factor SFi such that the luminance of corrected second image data DATA2 becomes the target luminance defined by the second curve data Slope2 described with reference to FIG. 10. The local load of the corrected second image data DATA2 may not exceed the second threshold value TH2.

In an embodiment, when at least one of the ith and (i+1)th difference values diff-i and diff-i+1 is greater than the predetermined threshold difference value, the calculator 1432 determines a maximum value SFi_max and a minimum value SFi_min for the ith scale factor SFi.

In an embodiment, the maximum value SFi_max and the minimum value SFi_min are predetermined corresponding to local loads LL and difference values diff. In an embodiment, the calculator 1432 receives information on the maximum value SFi_max and the minimum value SFi_min, which correspond to the local loads LL and the difference values diff, and determines the maximum value SFi_max and the minimum value SFi_min, based on the received information. In another embodiment, the calculator 1432 determines the maximum value SFi_max and the minimum value SFi_min from local loads LL and scale factors SF by using a predetermined calculation expression.

Alternatively, as described with reference to FIG. 10, the calculator 1432 may determine a reference scale factor, corresponding to the ith local load LL-i. The calculator 1432 may determine a value obtained by adding a predetermined first threshold range to the reference scale factor as the maximum value SFi_max, and determine a value obtained by subtracting a predetermined second threshold range from the reference scale factor as the minimum value SFi_min. The first threshold range and the second threshold range may have the same value or different values.

The method in which the calculator 1432 determines the maximum value SFi_max and the minimum value SFi_min is not limited to the above-described method. That is, the calculator 1432 may determine the maximum value SFi_max and the minimum value SFi_min in various manners as long as an occurrence of a rapid luminance difference between pixels coupled to adjacent data driver chips 131 due to corrected second image data DATA2 can be prevented as will be described later.

In an exemplary embodiment, the calculator 1432 determines a slope of a scale factor SF between the maximum value SFi_max and the minimum value SFi_min. For example, the calculator 1432 may determine the slope of the scale factor SF, based on third curve data Slope3 received from the outside. The slope may have a value fixed or varied between the maximum value SFi_max and the minimum value SFi_min.

When the maximum value SFi_max, the minimum value SFi_min, and the slope are determined as described above, the calculator 1432 may determine the ith scale factor SFi by using the maximum value SFi_max, the minimum value SFi_min, and the slope. The ith scale factor SFi may include a plurality of sub-factors determined according to the slope between the maximum value SFi_max and the minimum value SFi_min.

A number of the plurality of sub-scale factors may correspond to that of data lines coupled to the ith data driver chip 131 (i.e., k in the embodiment shown in FIG. 1). Accordingly, the plurality of sub-scale factors may respectively correspond to the data lines coupled to the ith data driver chip 131. That is, in the above embodiment, the scale factors SF1, SF2, SF3, . . . , and SFn generated by the scale factor generator 143 may be used for the respective data lines D1 to Dm.

The above embodiment is illustrated in more detail with reference to FIGS. 12 and 13. FIGS. 12 and 13 illustrate local loads LL with respect to 16 data driver chips 131 in an example in which the 16 data driver chips 131 are provided, and the second threshold value TH2 is set to 55%. Local loads LL before they are controlled by scale factors SF are illustrated in FIG. 12, and local loads LL controlled by the scale factors SF, based on the second threshold value TH2, are illustrated in FIG. 13.

When comparing FIGS. 12 and 13, difference values between sixth to eleventh data driver chips DIC #6 to DIC #11 and adjacent data driver chips do not exceed a predetermined threshold difference value (e.g., 20%). Therefore, local loads LL with respect to the sixth to eleventh data driver chips DIC #6 to DIC #11 are adjusted to the second threshold value TH2 or less.

At least one of difference values between fourth and fifth data driver chips DIC #4 and DIC #5 and adjacent data driver chips exceeds the threshold difference value (e.g., 20%). For example, since the load of data driver chip DIC #5 is 80% and the load of data driver chip DIC #4 is 5%, their difference is 75%, which exceeds the threshold difference value of 20%. Therefore, a maximum value SF_max and a minimum value SF_min are calculated for a scale factor SF of the fourth and fifth data driver chips DIC #4 and DIC #5. In addition, a slope is determined for the data driver chips DIC #4 and DIC #5. In the embodiment shown in FIG. 13, the slope is fixed as one value between the maximum value SF_max and the minimum value SF_min. However, the present disclosure is not limited thereto.

The scale factor SF of the fourth and fifth data driver chips DIC #4 and DIC #5 may include k sub-scale factors including at least one value between the maximum value SF_max and the minimum value SF_min according to the determined maximum value SF_max, the determined minimum value SF_min, and the determined slope. The sub-scale factors respectively correspond to k data lines coupled to the fourth and fifth data driver chips DIC #4 and DIC #5. For example, if the k sub-scale factors for the fourth and fifth data driver chips DIC #4 and DIC #5 is 5%, 30%, and 60%, and first image data DATA1 includes first grayscales for data lines associated with the fourth data driver chip DIC #4 and second grayscales for data lines associated with the fifth data driver chip DIC #5, then the first grayscales could be adjusted based on a first slope of a first line going through 5% and 30% and the second grayscales could be adjusted based on a second slope of a second line going through 30% and 60%. Thus, the grayscales can be gradually adjusted based on factors between 5% and 60% rather than all being adjusted based on the same scale factor (e.g., 55%).

As shown in FIG. 13, in the above embodiment, the scale factor SF may be applied to the fourth data driver chip DIC #4 of which a local load LL does not exceed the second threshold value TH2.

As described above, in the present disclosure, scale factors SF with respect to the data lines D1 to Dm can be generated based on local load difference values diff between adjacent data driver chips 131. In the present disclosure, a load (or luminance of image data corrected by a scale factor SF between adjacent data driver chips 131 is prevented from being rapidly changed, so that image quality degradation between pixels PX coupled to the adjacent data driver chips 131 can be minimized.

In a display device and a driving method thereof in accordance with at least one embodiment of the present disclosure, a driving current is individually limited with respect to each of the data driver chips, so that an overcurrent phenomenon caused by a difference in driving current between the data driver chips can be prevented.

Further, in a display device and a driving method thereof in accordance with at least one embodiment of the present disclosure, the display panel can be prevented from being burnt due to overcurrent of the data driver chips.

Further, in a display device and a driving method thereof in accordance with at least one embodiment of the present disclosure, an amount of driving current of the display panel is limited according to a data load, so that power consumption of the display panel can be reduced.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure.

What is claimed is:

1. A display device comprising:

a display panel configured to display an image, based on data signals supplied from data lines;

a load controller configured to determine a scale factor for adjusting a target luminance of the image displayed in the display panel, based on a load of first image data input from the outside; and a data driver configured to output the data signals to the data lines, the data signals corresponding to second image data generated by correcting the first image data using the scale factor, wherein the data driver includes a plurality of data driver chips coupled to at least one data line among the data lines, wherein the load controller determines the target luminance corresponding to local loads with respect to the respective data driver chips, based on predetermined first curve data when at least some of the local loads are greater than a first threshold value, and the load controller determines the scale factor such that the target luminance of the image displayed in the display panel becomes the determined target luminance, and wherein the load controller determines minimum and maximum values for the scale factor and sets the scale factor based on a line having a slope between the minimum and maximum values, when a difference between two of the local loads from two of the data driver chips that are adjacent one another exceed a predetermined threshold difference value.

2. The display device of claim 1, wherein the load controller comprises:

a total load calculator configured to calculate a total load of the first image data;

a first comparator configured to output a first enable signal for determining the scale factor, when the total load is greater than a second threshold value;

a local load calculator configured to calculate the local loads; and a second comparator configured to output a second enable signal for determining the scale factor, when at least some of the local loads are greater than the first threshold value.

3. The display device of claim 2, wherein the load controller further includes a mode determiner configured to output a first mode signal for determining the scale factor, based on the total load, and a second mode signal for determining the scale factor, based on the local loads.

4. The display device of claim 3, wherein the mode determiner outputs one of the first mode signal and the second mode signal according to whether the first enable signal and the second enable signal are output, and wherein the mode determiner outputs the second mode signal, when both the first enable signal and the second enable signal are output.

5. The display device of claim 3, wherein the total load calculator calculates the total load in response to the first mode signal, and the local load calculator calculates the local loads in response to the second mode signal.

6. The display device of claim 2, wherein, the load controller determines the target luminance corresponding to the total load, based on predetermined second curve data when the total load is greater than the second threshold value, and determines the scale factor such that the target luminance of the image displayed in the display panel becomes the determined target luminance.

7. The display device of claim 2, wherein the load controller comprises:

a difference value generator configured to determine difference values with the local loads between adjacent data driver chips; and a calculator configured to determine the scale factor, based on whether the difference values exceed the predetermined threshold difference value.

8. The display device of claim 7, wherein the calculator determines the scale factor corresponding to the local load, based on predetermined the first curve data, when difference values corresponding to the local load with respect to a given data driver chip among the data driver chips are smaller than the threshold difference value.

9. The display device of claim 7, wherein the calculator determines the maximum value and the minimum value for the scale factor and the slope between the maximum value and the minimum value, when at least one of difference values corresponding to the local load with respect to given data driver chip among the data driver chips is greater than the threshold difference value, and determines a plurality of sub-scale factors including at least one value between the maximum value and the minimum value.

10. The display device of claim 9, wherein the plurality of sub-scale factors respectively correspond to at least one of the data lines coupled to the given data driver chip.

11. The display device of claim 9, wherein the calculator determines a predetermined maximum value and a predetermined minimum value as the maximum value and the minimum value respectively, corresponding to the local load and the difference values.

12. The display device of claim 9, wherein the calculator determines a reference scale factor corresponding to the local load, based on predetermined the first curve data, determines the maximum value by adding a predetermined threshold range to the reference scale factor, and determines the minimum value by subtracting a predetermined second threshold range from the reference scale factor.

13. The display device of claim 9, wherein the slope has a value fixed or varied between the maximum value and the minimum value.

14. A method for driving a display device comprising a display panel for displaying an image, based on data signals supplied from data lines, and a data driver including a plurality of data driver chips coupled to at least one data line among the data lines, the method comprising:

determining a scale factor for adjusting a target luminance of the image displayed in the display panel, based on a load of first image data input from the outside;

outputting data signals to the data lines, corresponding to second image data generated from correcting the first image data using the scale factor; and displaying the image in the display panel, based on the data signals, wherein the determining of the scale factor further comprises:

determining the target luminance corresponding to local loads with respect to the respective data driver chips, based on predetermined first curve data when at least some of local loads are greater than a first threshold value; and determining the scale factor such that the target luminance of the image displayed in the display panel becomes the determined target luminance, and wherein the determining determines minimum and maximum values for the scale factor and sets the scale factor based on a line having a slope between the minimum and maximum values, when a difference between two of the local loads from two of the data driver chips that are adjacent one another exceed a predetermined threshold difference value.

15. The method of claim 14, wherein the determining of the scale factor comprises:

calculating the total load of the first image data;

outputting a first enable signal for determining the scale factor, when the total load is greater than a second threshold value;

calculating the local loads; and outputting a second enable signal for determining the scale factor, when at least some of the local loads are greater than the first threshold value.

16. The method of claim 15, wherein the determining of the scale factor further comprises:

determining the target luminance corresponding to the total load, based on predetermined second curve data when the total load is greater than the second threshold value; and determining the scale factor such that the target luminance of the image displayed in the display panel becomes the determined target luminance.

17. The method of claim 15, wherein the determining of the scale factor further comprises:

determining difference values of the local loads between adjacent data driver chips; and calculating the scale factor, based on whether the difference values exceed the predetermined threshold difference value.

18. The method of claim 17, wherein the calculating of the scale factor comprises determining the scale factor corresponding to a given one of the local loads, based on predetermined the first curve data, when difference values corresponding to a local load with respect to given data driver chip among the data driver chips are smaller than the threshold difference value.

19. The method of claim 17, wherein the calculating of the scale factor comprises:

determining the maximum value and the minimum value for the scale factor and the slope between the maximum value and the minimum value, when at least one of a plurality of difference values corresponding to a local load with respect to a given data driver chip among the data driver chips is greater than the threshold difference value; and determining a plurality of sub-scale factors including at least one value between the maximum value and the minimum value.

20. The method of claim 19, wherein the plurality of sub-scale factors respectively correspond to at least one of the data lines coupled to the given data driver chip.

* * * * *